US008221134B2

(12) United States Patent
Dove

(10) Patent No.: US 8,221,134 B2
(45) Date of Patent: Jul. 17, 2012

(54) SOLDERLESS CONNECTOR ASSEMBLY

(75) Inventor: Harold Daniel Dove, Anaheim, CA (US)

(73) Assignee: Basic Electronics, Inc., Garden Grove, CA (US)

( * ) Notice: Subject to any disclaimer, the term of this patent is extended or adjusted under 35 U.S.C. 154(b) by 66 days.

(21) Appl. No.: 12/965,736

(22) Filed: Dec. 10, 2010

(65) Prior Publication Data

US 2012/0149230 A1 Jun. 14, 2012

(51) Int. Cl.
*H01R 12/00* (2006.01)

(52) U.S. Cl. ..... 439/67; 439/493

(58) Field of Classification Search ..... 439/67, 439/77, 374, 378, 379, 492, 493
See application file for complete search history.

(56) References Cited

U.S. PATENT DOCUMENTS 3,951,497 A 4/1976 Balzano et al.
4,802,866 A 2/1989 Balzano et al.
4,948,951 A 8/1990 Balzano
5,565,124 A 10/1996 Balzano
5,600,115 A 2/1997 Balzano
5,691,509 A 11/1997 Balzano
6,232,552 B1 5/2001 Balzano
6,257,329 B1 7/2001 Balzano
6,347,915 B1 2/2002 Balzano
6,488,532 B2 12/2002 Balzano
6,739,878 B1 5/2004 Balzano

*Primary Examiner* — Khiem Nguyen
(74) *Attorney, Agent, or Firm* — Stetina Brunda Garred & Brucker

(57) ABSTRACT

A connector assembly is provided for communicating electrical signals between a pin connector having a plurality of connector pins and a remote location. The assembly comprises a connector defining a connector top surface and a plurality of pins extending therethrough, the pins each defining a pin contact surface extending above the connector top surface less than 0.1 inches. A collar is engaged about the connector body, the collar having an upper surface substantially coplanar with the connector top surface. A flexible cable has a plurality of electrical connectors extending therethrough, the cable defining a plurality of cable contact pads being in electrical communication with the flexible cable conductors. A retaining member is engageable to the collar for urging the flexible cable contact pads into electrical communication with the pin contact surfaces.

20 Claims, 3 Drawing Sheets

SOLDERLESS CONNECTOR ASSEMBLY

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to connector assemblies and, more particularly, to a solderless connector assembly for interfacing pin connectors to multi-connector flexible cables.

Electrical systems commonly include various circuits and assemblies that interconnect that form the overall system. Components of this system may be manufactured by different companies, or otherwise constructed in a modular form such that the different components may be removed, replaced or upgraded without the need to disassemble the whole system. Multi-connector cables are commonly used to communicate electrical signals, including power signals, information signals, clock signals, etc. between modules, and between electrical systems. In some cases the cables may have pin connectors affixed to one or both ends which engage mating connectors on another component. Such connectors may be mated to conventional cables by means of a corresponding female connector. However, repeated engagement and disengagement of such male and female pin connectors can cause pin damage, or otherwise bend the connectors such that reliable connectivity may be jeopardized when the connector is exposed to vibrations or other severe environmental conditions, such as may occur in aerospace applications or the like.

Faced with such problems, some suppliers have chosen to connect the individual pin conductors to conductive traces formed on the circuit board. This is a tedious process, though the end result may be a generally reliable connection. Moreover, soldering is an undesirable process, requiring tin/lead solder, flux and cleaning solutions, all of which can contain materials hazardous to operators and the environment, while creating more costs for management, making control of the processes more difficult, and requiring the proper treatment and disposal of hazardous materials.

Repair and replacement activities also become more difficult and time consuming where the connector contacts need to be soldered and desoldered. For example, the cables may themselves fail over time and need to be replaced, requiring repetition of the process. In other cases, the integrity of the cable may simply be uncertain, and replacement of the cable may be a trouble shooting option that is preferable to replacing a complex and expensive circuitry component. Again, the soldered connections between the cable and the circuit board make that option more difficult and tedious.

Accordingly, it is desirable to provide a cable connector that can be reliably engaged to pin connectors, yet disconnectable and replaceable without the need to perform soldering or desoldering functions. Preferably such a connector should also be able to withstand vibrations and other environmental conditions that might otherwise degrade connector performance over time.

Moreover, it is desirable to provide a cable connector that does not require a mounting board connected to the pin contacts, or conductive traces leading from the pin contacts to contact pads formed on the mounting board.

Additionally, it is preferable to provide a cable connector assembly wherein contact areas on the flexible cable need not be raised in order to reliably remain in electrical communication with the pin contacts.

Still further, it is preferable that such connector might be readily replaceable as useful for maintenance demands, as trouble shooting requires, or as system modifications evolve to utilize flexible cables having different types of connective patterns.

BRIEF SUMMARY

A connector assembly is provided for communicating electrical signals between a pin connector having a plurality of connector pins and a remote location. The assembly comprises a connector defining a connector top surface and a plurality of pins extending therethrough, the pins each defining a pin contact surface extending above the connector top surface less than 0.1 inches. A collar is engaged about the connector body, the collar having an upper surface substantially coplanar with the connector top surface. A flexible cable has a plurality of electrical connectors extending therethrough, the cable defining a plurality of cable contact pads being in electrical communication with the flexible cable conductors. A retaining member is engageable to the collar for urging the flexible cable contact pads into electrical communication with the pin contact surfaces.

The connector may further include a contact alignment disk having a plurality of apertures through which the plurality of pins extend, the alignment disk having an upper surface which defines the connector top surface.

In some embodiments pin pads are formed on the connector top surface to define pin pad contact surfaces that are in electrical communication with the pins that may be substantially flush with the connector top surface, or extend only partly through the contact alignment disk.

The pin contact surfaces/pin pad contact surfaces may extend above the connector top surface less than 0.01 inches. In the presently preferred embodiment, the pin contact surfaces/pin pad contact surfaces extend above the connector top surface approximately 0.004 inches.

In the presently preferred embodiment the collar is threadably engageable to the connector and includes a set screw, extendable through the collar, to lock the collar in rotational position relative to the connector.

The resilient member may be disposed intermediate the retaining member and the flexible cable contact pads, for resiliently urging the flexible cable contact pads into electrical communication with the pin contact surfaces/pin pad contact surfaces. The collar may include a plurality of alignment pins and the flexible cable may include a plurality of alignment apertures through which the pins may extend, to facilitate rotation of the collar and the flexible cable contact pads relative to the pin contact surfaces/pin pad contact surfaces.

The flexible cable contact pads and the pin contact surfaces/pin pad contact surfaces may be alignable in substantial vertical registry in response to rotation of the collar.

The retaining member, flexible cable and locking collar may each include a plurality of fastening apertures, with a plurality of fasteners extending through the fastening apertures to secure the retaining member, flexible cable and locking collar in locking vertical engagement.

A set screw is engageable to the locking collar for locking a collar and the flexible cable contact pads in rotational position relative to the connector and the pin contact surfaces/pin pad contact surfaces.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
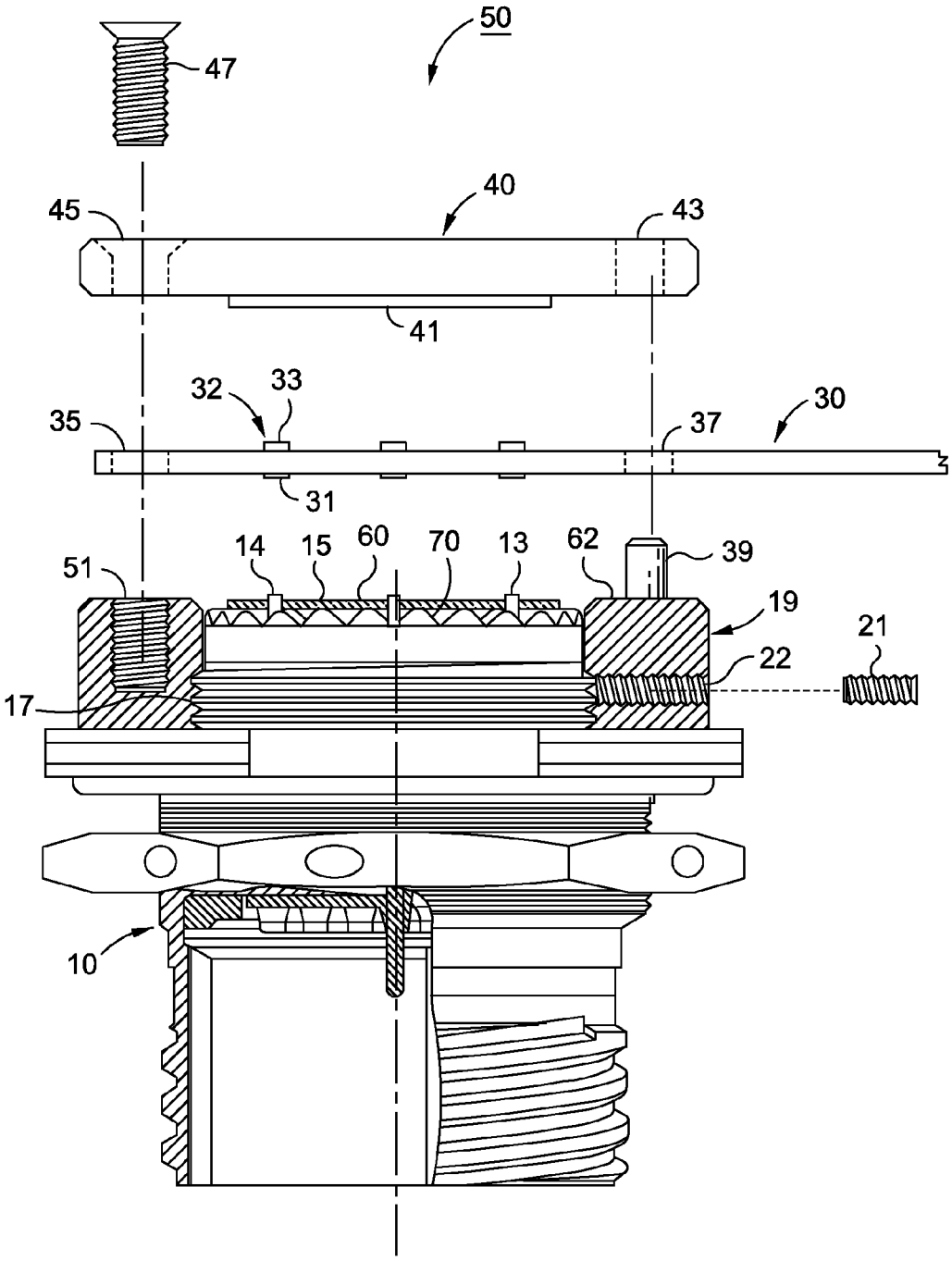
FIG. 1 front view of one embodiment of a connector assembly formed in accordance with the present invention.
Figure 2:
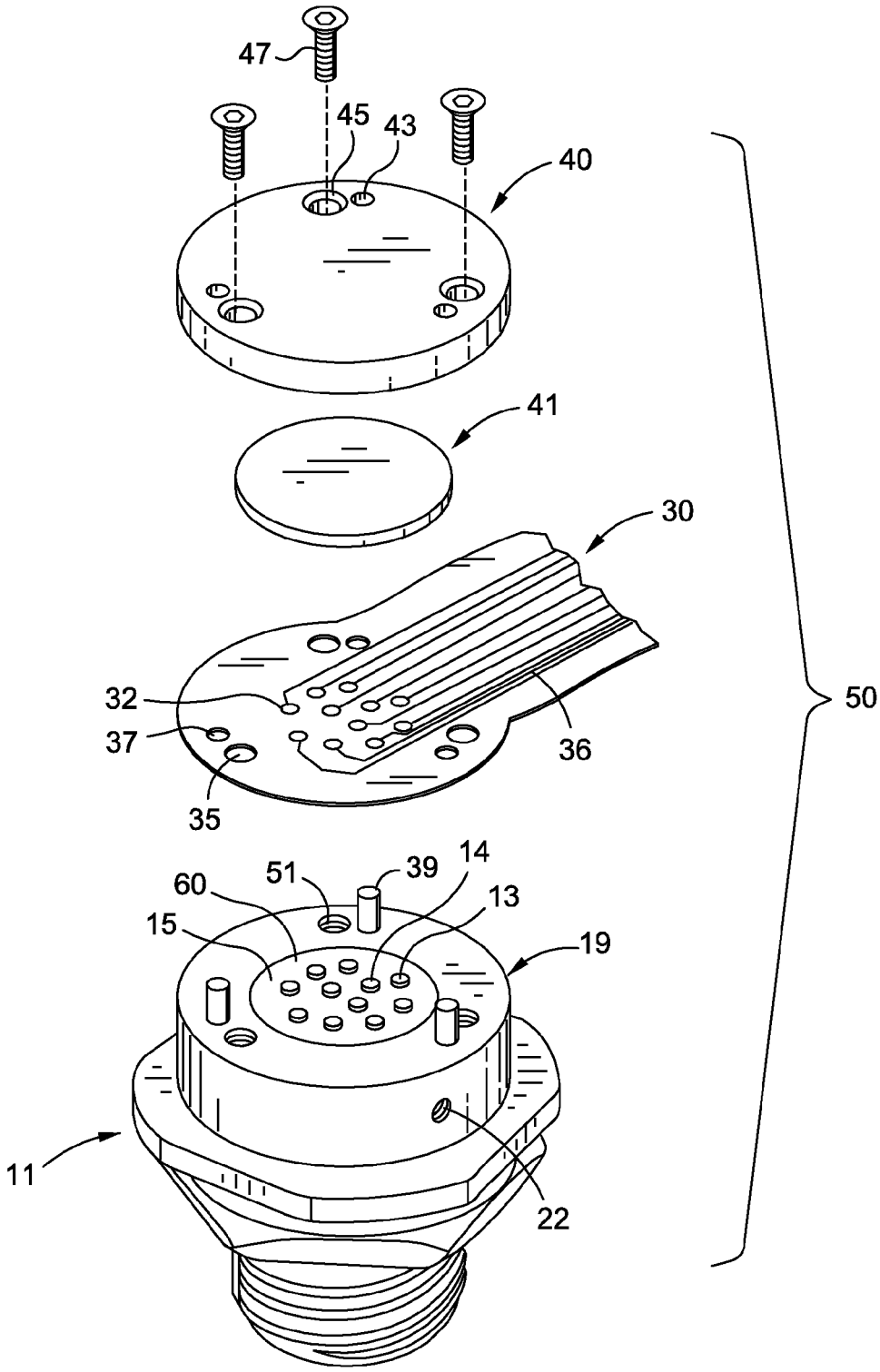
FIG. 2 is an exploded perspective view of the exemplary connector assembly shown at FIG. 1.

Referring to the drawings, FIGS. 1 and 2 illustrate an exemplary connector assembly formed in accordance with the present invention. As shown therein the connector assembly 50 includes a connector 10 through which electrical conductors pass, normally terminating in a plurality of conductor pins 13. The connector 10 defines an upper surface 60 which may be formed by insulating contact alignment disk 15, which typically overlies a body of insulating potting material 70. Disk 15 and the underlying potting material 70 serve to support and facilitate alignment and isolation of the pins 13. In another embodiment, the disk 15 may be eliminated, with the upper surface of the connector 10 defined by the upper surface of the potting material 70.

The alignment disk, where used, is typically perforated with an aperture pattern that conforms to the pin pattern of the pin connector.

The pin contact surfaces 14 may be formed from a conventional pin connector, by reducing the length of the pins, e.g. by cutting or grinding, from their normal length to a length that is substantially flush with the upper surface of alignment disk 15. In the presently preferred embodiment, the pins are shortened to define pin contact surfaces 14, which extend approximately 0.004 inches or less above the surface of insulating disk 15. However, in some embodiments it is anticipated that the pin contact surfaces may extend 0.10 inches or more above the surface of disk 15, depending upon factors such as the resolution of the adjacent surfaces, whether the flexible cable contact pads include raised surfaces, the shape and resiliency of the flexible cable contact surfaces, etc. Importantly, this embodiment of the present invention avoids the needs for electrically connecting the pins to associated electrically conductive traces on a mounting board, by converting the upper surface of the pins themselves into contact surfaces to which the flexible cable pads may be directly connected.

Figure 3:
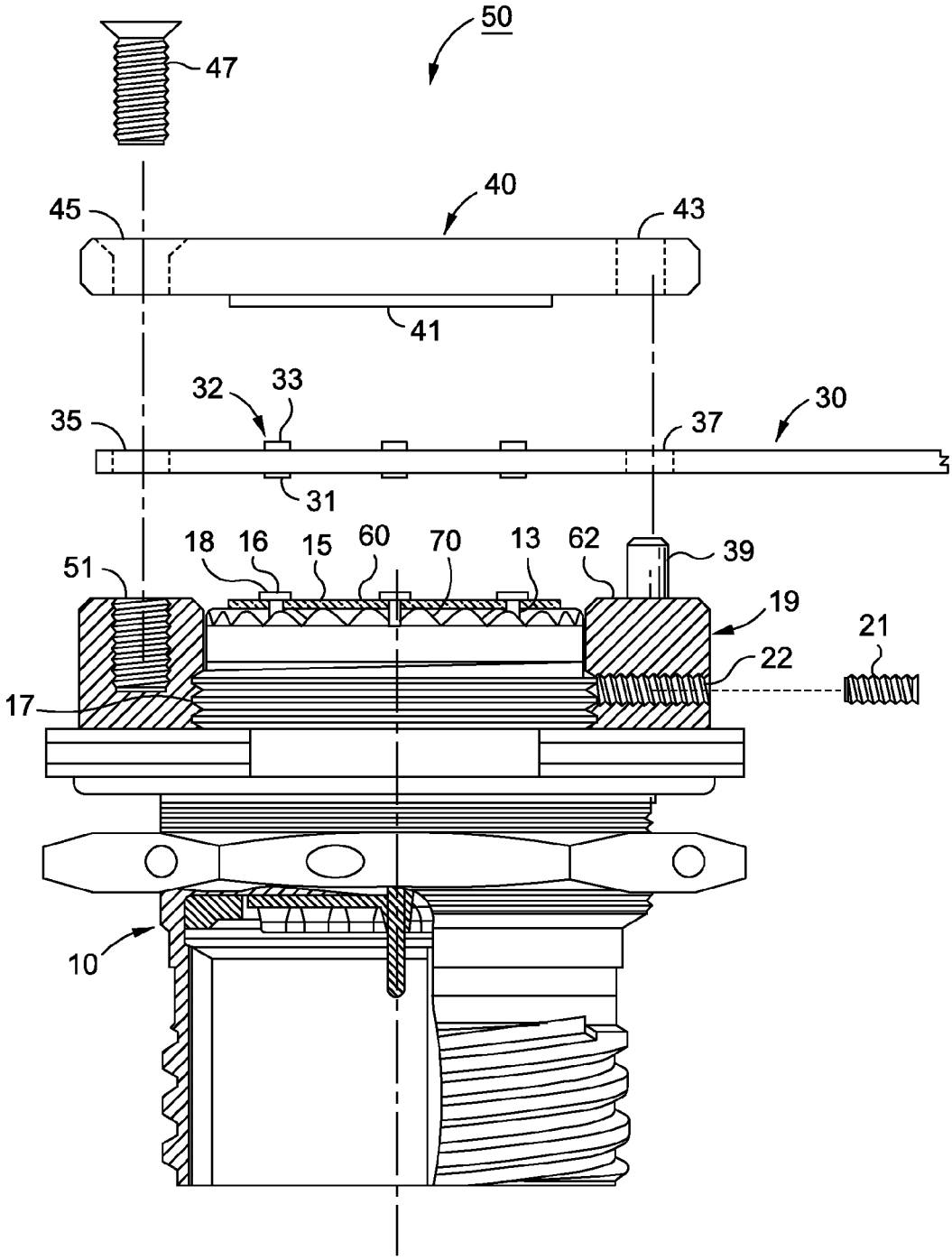
FIG. 3 is a front view of another embodiment of a connector assembly formed in accordance with the present invention.

In the embodiment shown at FIG. 3, the pins may be shortened to be generally flush with the upper surface of disk 15, with pin pads 16 formed on the upper surface of disk 15. Each pin pad 16 defines a pin pad contact surface 18 which is in electrical communication with an associated pin, and the upper surface of the pin underlays the pad contact surface.

In yet another embodiment, the pin apertures in disk 15 may be metalized to form conductive vias, which may be extended onto the surface of disk 15 to form pin pads 16. In this embodiment, the pins 15 need not even extend to the upper surface of disk 15, but need only be in contact with the conductive vias.

Those of ordinary skill in the art will recognize that these and other techniques are readily available to form pin contact surfaces, contact pads, or other contact surfaces that are in electrical communication with associated pins, and allow for electrical communication with corresponding contacts on a flexible cable. In each case, the pins need not extend into a mating pin connector to communicate signals to the flexible cable. The invention requires only that a surface area associated with the pins be defined to permit abutting electrical communication with the contact surfaces of the flexible cable 30.

Flexible cable 30 defines a plurality of conductors 36, each of which being associated with a dedicated flexible cable contact pad 32. The contact pads 32 may include raised surface portions 31, 33, which extend from the bottom and/or top of a flexible cable 30, as shown at FIG. 1.

The flexible cable pads 32 are urged into electrical communication with the pin contact surfaces 14/pin pads 16 in response to engagement of the retaining member 40 to locking collar 19, which may be threadably engaged to connector body 10 via screw threads 17. Resilient member 41 may be formed as a resilient pad disposed on the bottom of the retaining member 40, i.e. intermediate the retaining member 40 and the flexible cable 30. Resilient member 41 functions to resiliently urge the flexible cable contact pads into electrical communication with the pin contact surfaces 14/pin pad contact surfaces 18.

The collar 19 is sized to have an inner diameter that closely mates to and supports the upper surface of connector body 11. Collar 19 is preferably formed to have a height such that, when engaged to connector 10, the upper surface 62 of collar 19 is substantially coplanar with the upper surface of the alignment disk 15, or the pin contact pads 14.

The collar 19 may include a plurality of alignment pins 29 which are extendable through flexible cable aperture 37 and retaining member aperture 43. The alignment pins 29 align the flexible cable 30 and retaining member 40 in place relative to the collar 19. In order to insure that the pattern of conductive pads 32 are locked in alignment relative to the pattern of pin contacts 14, the locking collar may be rotated to a proper alignment position and then locked in rotational position by set screw 21. Screws 47 extend through the retaining member aperture 45, flexible cable aperture 35 and engage to collar aperture 51. As a result, the flexible cable pads 32 are secured in vertical registry with the pin contacts 14.

Accordingly, proper registry of the pin contact surfaces 14/pads contact surfaces 18 with the flexible cable contact pads 32 requires that the collar 19 be secured to the connector housing 10, that the flexible cable 30 be engaged to pins 39 to maintain registry between the flexible cable pads 32 and the collar 19. The collar may then be positioned, e.g. rotated, to align the patterns, and locked in that position. Retaining member 40 may then be secured to a collar 19, by means of screws 47, to compress resilient member 44 upon the flexible cable 30, to urge flexible cable pads 32 into resilient electrical communication with the pin contact surfaces 14/pad contact surfaces 18

In another embodiment, the collar 19 may be fixed in proper alignment position, without the need for rotation or locking the collar in position. In such embodiment, the position of the flexible cable pads 32 and the flexible cable apertures 35, 37 is reliably known, so that no adjustment of the position of the flexible cable 30 relative to the pin contact surfaces 14/pad contact surfaces 18 is necessary to insure proper vertical registry.

The flexible cable may be formed to include a pattern of conductive pads on the first end of the cable, with each conductive pad being in electrical communication with a conductor extending through the flexible cable. As described above, the flexible cable pads may include raised surface contact areas, which may be formed for complementary engagement to the pin contacts. Where the flexible cable is formed to define raised contact areas, the flexible cable may be formed generally in accordance with the flexible cable described in U.S. Pat. No. 5,691,509 to Balzano and U.S. Pat. No. 6,739,878, also to Balzano. The contents of those prior patents are incorporated herein by reference.

As will be apparent to those of ordinary skill in the art, various modifications, improvements or enhancements may be made to the embodiments described herein, without departing from the broader aspects of the present invention. For example, while flexible cable pads 32 are illustrated as including raised surface portions 31, 33, the pin pads may alternately be formed to be substantially flush with the surface of flexible cable 30, e.g. where the pin pads extend sufficiently from the insulating disk to insure reliable electrical communication therebetween. In such an alternate embodiment the height of the collar 19 may be slightly lower such that the retaining member 40 and resilient member 41 may further urge the flexible cable pads 32 into contact with the pin pad contact surface 18.

Additionally, the shape and construction of the collar 19 and retaining member 40 may be varied to include different connecting arrangements, while still retaining the functionality of anchoring the flex cable and retaining member relative to the upper surface of connector 18.

What is claimed is:

1. A connector assembly for communicating electrical signals between a pin connector having a plurality of connector pins and a remote location, the assembly comprising:

a connector defining a connector top surface and having a plurality of pins extending therethrough, the pins each defining a pin contact surface extending above the connector top surface less than 0.1 inch;

a collar extending about the connector body, the collar having an upper surface substantially coplanar with the connector top surface;

a flexible cable having a plurality of electrical conductors extending therethrough, the flexible cable defining a plurality of cable contact pads, the cable contact pads being in electrical communication with the flexible cable conductors; and a retaining member engageable to the collar for urging the flexible cable contact pads into electrical communication with the pin contact surfaces.

2. The assembly as recited in claim 1 wherein the pin contact surfaces extend above the connector top surface less than 0.01 inch.

3. The assembly as recited in claim 1 wherein the collar is threadably engageable to the connector.

4. The assembly as recited in claim 3 wherein the collar further includes a set screw extendable through the collar to lock the collar in rotational position relative to the connector.

5. The assembly as recited in claim 1 further including a resilient member disposed intermediate the retaining member and the flexible cable contact pads, for resiliently urging the flexible cable contact pads into electrical communication with the pin contact surfaces.

6. The assembly as recited in claim 1 wherein the flexible cable includes a plurality of alignment apertures, and the collar includes a plurality of alignment pins, the alignment apertures being engageable to the alignment pins to facilitate rotation of the collar and the flexible cable contact pads relative to the pin contact surfaces.

7. The assembly as recited in claim 6 wherein the cable contact pads and the pin contact surfaces are alignable in substantial vertical registry in response to rotation of the collar.

8. The assembly as recited in claim 7 wherein the retaining member, the flexible cable and the collar each include a plurality of fastening apertures, with a corresponding plurality of fasteners extending through the fastening apertures to secure the retaining member, the flexible cable and the collar in locking vertical engagement.

9. The assembly as recited in claim 8 further including a locking screw engageable for the collar for locking the collar and the flexible cable contact pads in rotational position relative to the connector and the pin contact surfaces.

10. The assembly as recited in claim 1 wherein the connector further includes a contact alignment disk having a plurality of apertures through which the plurality of pins extend, the alignment disk having an upper surface which defines the connector top surface.

11. A connector assembly for communicating electrical signals between a pin connector having a plurality of connector pins and a remote location, the assembly comprising:

a pin connector defining a connector top surface and having a plurality of pins extending at least substantially therethrough, the pins being in electrical communication with pin pads formed on the connector top surface, the pins each defining a pad contact surface extending above the connector top surface less than 0.1 inch;

a collar extending about the connector body, the collar having an upper surface substantially coplanar with the connector top surface;

a flexible cable having a plurality of electrical conductors extending therethrough, the flexible cable defining a plurality of cable contact pads, the cable contact pads being in electrical communication with the flexible cable conductors; and a retaining member engageable to the collar for urging the flexible cable contact pads into electrical communication with the pad contact surfaces.

12. The assembly as recited in claim 11 wherein the pad contact surfaces extend above the connector top surface less than 0.01 inch.

13. The assembly as recited in claim 11 wherein the collar is threadably engageable to the connector.

14. The assembly as recited in claim 13 wherein the collar further includes a set screw extendable through the collar to lock the collar in rotational position relative to the connector.

15. The assembly as recited in claim 11 further including a resilient member disposed intermediate the retaining member and the flexible cable contact pads, for resiliently urging the flexible cable contact pads into electrical communication with the pad contact surfaces.

16. The assembly as recited in claim 11 wherein the flexible cable includes a plurality of alignment apertures, and the collar includes a plurality of alignment pins, the alignment apertures being engageable to the alignment pins to facilitate rotation of the collar and the flexible cable contact pads relative to the pad contact surfaces.

17. The assembly as recited in claim 16 wherein the cable contact pads and the pad contact surfaces are alignable in substantial vertical registry in response to rotation of the collar.

18. The assembly as recited in claim 17 further including a locking screw engageable for the collar for locking the collar and the flexible cable contact pads in rotational position relative to the connector and the pad contact surfaces.

19. The assembly as recited in claim 18 wherein the retaining member, the flexible cable and the collar each include a plurality of fastening apertures, with a corresponding plurality of fasteners extending through the fastening apertures to secure the retaining member, the flexible cable and the collar in locking vertical engagement.

20. The assembly as recited in claim 11 wherein the connector further includes a contact alignment disk having a plurality of apertures into which the plurality of pins extend, the alignment disk having an upper surface which defines the connector top surface.

* * * * *